US005127111A

United States Patent [19]

Sieth

[11] Patent Number: 5,127,111

[45] Date of Patent: Jul. 7, 1992

[54] SHEET FLOW SPOUT ASSEMBLY

[75] Inventor: Kenneth J. Sieth, Cedarburg, Wis.

[73] Assignee: Kohler Co., Kohler, Wis.

[21] Appl. No.: 640,195

[22] Filed: Jan. 11, 1991

[51] Int. Cl.[5] ..... A47K 3/02

[52] U.S. Cl. ..... 4/591; 4/569; 239/556

[58] Field of Search ..... 4/191, 192, 568, 569, 4/541, 542, 591, 538; D23/255-257; 239/396, 520, 521, 523, 556, 565, 590, 597

[56] References Cited

U.S. PATENT DOCUMENTS

| | | | |
|---|---|---|---|
| 372,347 | 11/1887 | Wells . | |
| 493,194 | 3/1893 | Stifel et al. . | |
| 755,109 | 3/1904 | Bussenius . | |
| 920,575 | 5/1909 | Ike . | |
| 1,198,303 | 9/1916 | Williams | 4/591 |
| 1,392,901 | 10/1921 | Adair . | |
| 1,393,482 | 10/1921 | Abraham et al. | 4/591 |
| 1,436,538 | 11/1922 | Schiller . | |
| 1,438,373 | 12/1922 | Gould . | |
| 1,563,783 | 12/1925 | Paul . | |
| 2,024,938 | 12/1935 | Marshall | 239/565 X |
| 2,430,297 | 12/1944 | Lombardi | 4/181 |
| 2,499,966 | 3/1950 | Neely | 4/150 |
| 3,579,667 | 5/1971 | Giglio | 4/591 |
| 4,334,328 | 6/1982 | Delepine | 4/191 |
| 4,340,982 | 7/1982 | Hart et al. | 4/541 |
| 4,513,458 | 4/1985 | Delepine | 4/191 |
| 4,912,782 | 4/1990 | Robbins | 4/192 |

*Primary Examiner*—Charles E. Phillips
*Attorney, Agent, or Firm*—Quarles & Brady

[57] ABSTRACT

A spout provides an extended sheet of flowing water for a bathtub or the like with readily obtainable rates of water flow and pressure. The spout employs a plurality of water jets along a tubular conduit which form a thin continuous sheet after striking a vertical tub wall. Slotted nozzles at either end of the conduit form a fan spray, one edge of each which attaches to the continuous sheet to provide the aesthetic impression of a continuous higher volume flow. The conduit may be supported by a bracket bolted to the vertical wall. A shroud having a planar back wall and a series of downwardly opening notches may be installed between the conduit and the bracket after the bolts are in place, simplifying the installation of the spout.

6 Claims, 3 Drawing Sheets

FIG. 1
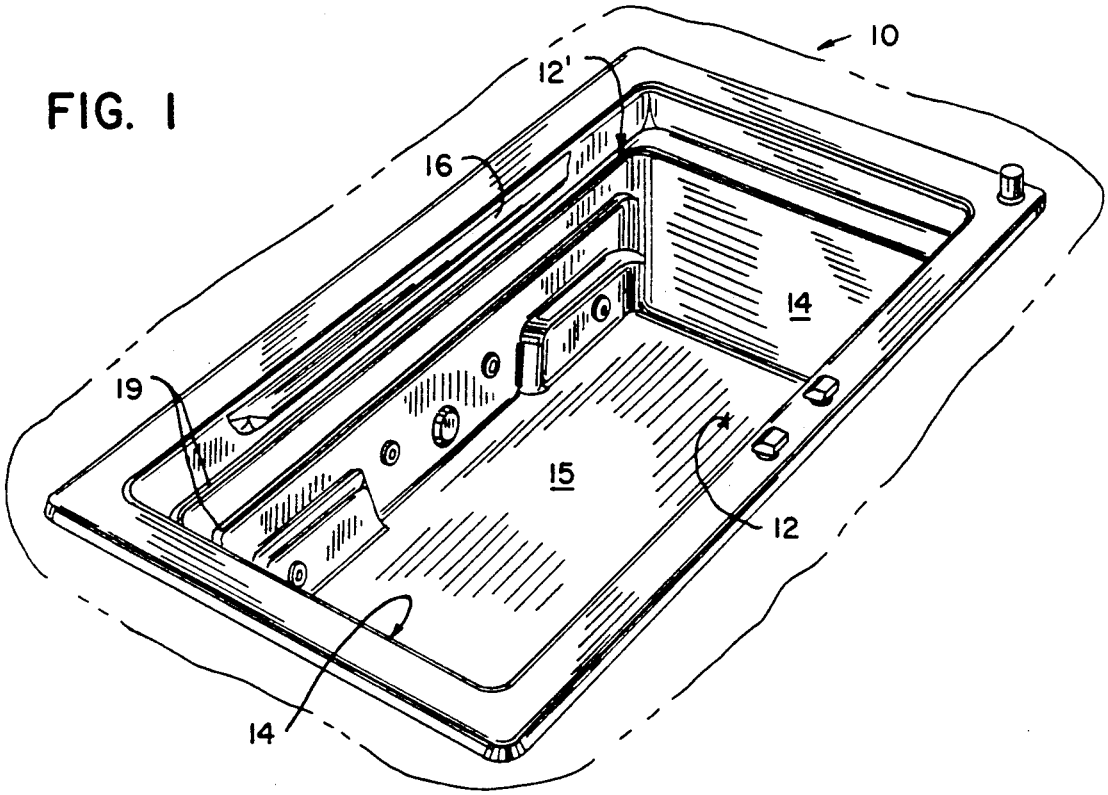
FIG. 7
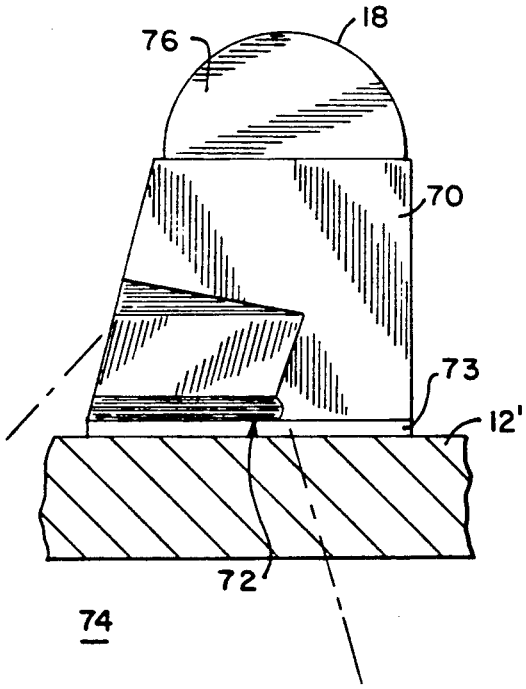
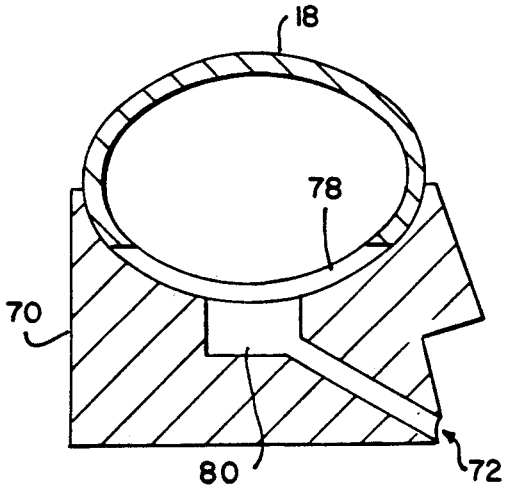
FIG. 8

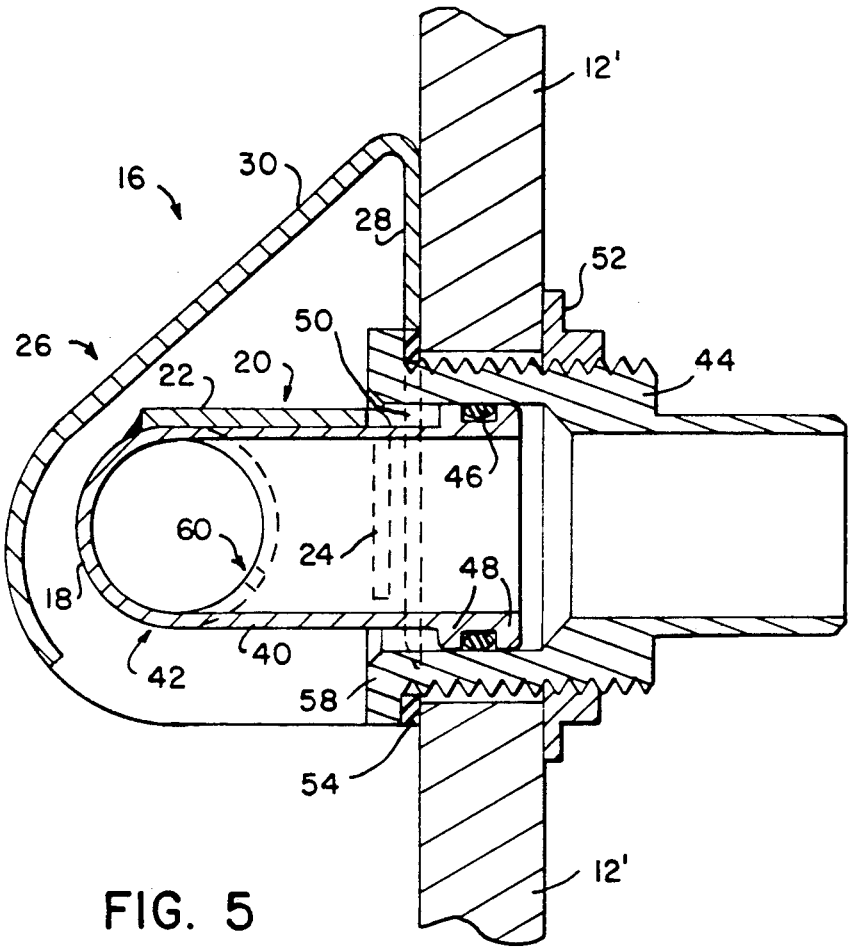
FIG. 5
FIG. 6
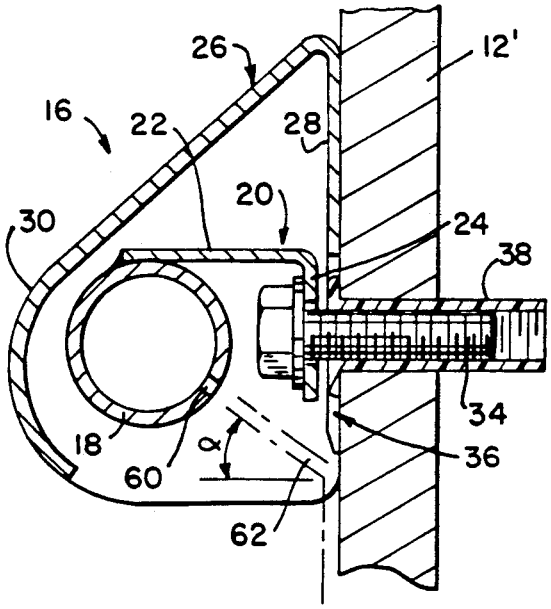

SHEET FLOW SPOUT ASSEMBLY

BACKGROUND OF THE INVENTION

1. Field of the Invention

The invention relates to very long spouts for providing a stream of water in the shape of a sheet or curtain directly on a tub wall. In particular, the design is particularly well suited for tubs having undulated side walls.

2. Background of the Art

Some types of spouts for dispensing a narrow sheet of water directly into a bathtub basin, are known. Water flowing in a sheet from such spouts is aesthetically pleasing. However, such spouts are suitable only for relatively narrow sheets of water. For sheets of water having a width of over several feet, for example, such designs would require water flow and pressure unsupportable with standard plumbing, and inter alia would lead to unacceptable noise and splashing problems. The art also has developed tub wall inlet systems where water entered in conventional strip fashion against the sides of the tub. However, such systems often required header space needed for other uses in two person tubs, were complex and expensive, and did not involve the type of undulating head of water desirable here. Therefore, it can be seen that a need existed for an improved spout assembly.

SUMMARY OF THE INVENTION

The present invention provides a spout for forming a substantially continuous sheet of water over an extended length. The center of the sheet of water flow is created by the combined effect of a plurality of individual water jets directed against the vertical wall of a tub or the like. Slotted nozzles on either side of the jets generate fans of water whose edges join to the sheet formed by the water jets to create a visually continuous sheet flow.

Specifically, a conduit with an inlet pipe between its lateral ends is positionable laterally along an upper edge of a vertical wall of the tub and is held in a spaced relationship, adjacent to the wall, by a bracket attachable to the wall. A plurality of ports positioned along the length of the conduit receive a portion of flowing water from the inlet, through the conduit, and direct the water, in a plurality of jets, at the vertical wall to form a continuous sheet of water against that wall. A nozzle at one end of the conduit receives another portion of flowing water and directs the water into the tub in a fan, in a partially lateral direction, and with one edge of the fan adjacent to the continuous sheet of water attached to the wall.

It is one object of the invention to create a wide, continuous sheet of water with readily obtainable water flow rates and pressures. The water jets provide a precise metering of the flow of water to the sheet, such flow being relatively insensitive to fluctuations in water pressure. The use of the vertical wall of the tub to form the sheet permits the sheet as attached to the wall to be thinner than required in a free falling sheet not attached to the wall, and thus more economical of water. The fan sprays of water from the slotted nozzles connect to this thinner sheet to provide an aesthetic impression of a single, continuous free falling sheet of water. Also, they extend the width of the sheet while leaving the user more shoulder room near the ends of the tub.

It is another object of the invention to provide a spout for producing an extended sheet flow of water that is easily installed. The spout may include a shroud extending laterally along the conduit and having a back wall capturable between the tub vertical wall and the bracket and having a laterally extending bottom opening for permitting unobstructed passage of the jets. The bracket may be held against the vertical wall by a plurality of bolts and the back wall of the shroud may have a plurality of downward opening slots to permit the back wall to slide around the bolts and to be clamped between the bracket and the vertical wall by the bolts. Thus, the shroud may be easily installed after the conduit and attaching bolts are in place.

Other objects and advantages besides those discussed above will be apparent to those skilled in the art from the description of the preferred embodiment of the invention which follows. For example, the maintenance of the sheet as it passes the undulations below the spout is a unique visual effect. Thus, in the description, reference is made to the accompanying drawings, which form a part hereof, and which illustrate one example of the invention. Such example, however, is not exhaustive of the various alternative forms of the invention. Therefore, reference should be made to the claims which follow the description for determining the full scope of the invention.

BRIEF DESCRIPTION OF THE DRAWINGS

FIG. 1 is a perspective view of a bathtub incorporating the spout assembly of the present invention;

FIG. 5 is a cross sectional view of the spout assembly taken along line 5—5 of FIG. 4;

FIG. 6 is a cross sectional view of the spout assembly taken along line 6—6 of FIG. 4;

FIG. 7 is a cross sectional view of the spout assembly taken along line 7—7 of FIG. 4; and FIG. 8 is a cross sectional view of the spout assembly taken along line 8—8 of FIG. 3.

DESCRIPTION OF THE PREFERRED EMBODIMENT

Figure 2:
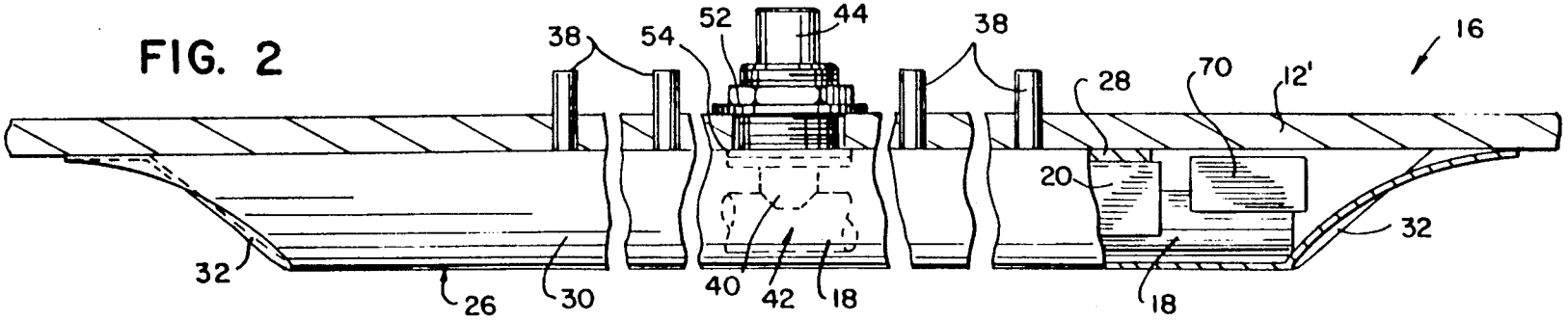
FIG. 2 is a top plan view (in partial cut-away) of the spout portion of FIG. 1.

Referring to FIG. 1, a bathtub 10 has two upstanding and laterally extending sidewalls 12 arranged with shorter transverse endwalls 14 about a generally rectangular bottom 15. Extending laterally along the upper edge of one sidewall 12' is a spout 16 for producing a sheet flow of water as will be described in detail below. Lateral ridges or undulations 19 are formed in the sidewall 12 under the spout to produce a series of ripples in the sheet flow as it descends into the tub volume.

Figure 4:
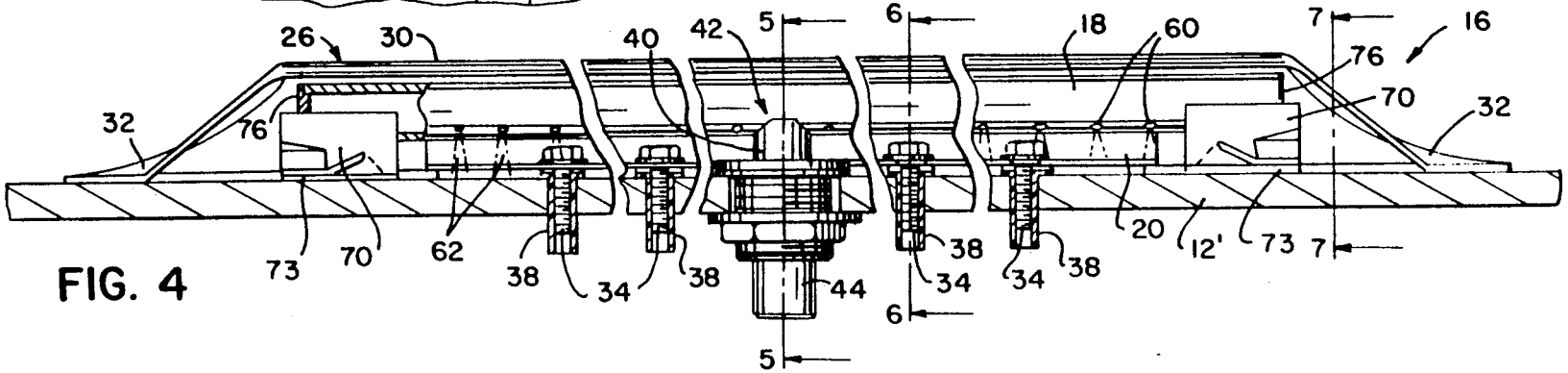
FIG. 4 is a view similar to that of FIG. 2 but looking up from the bottom of the tub.

Referring generally to FIGS. 2, 4 and 6, the spout assembly 16 includes a laterally extending tubular conduit 18 centered near the top of the sidewall 12' and attached to and spaced from the sidewall 12' by L-bracket 20. The L-bracket 20 has vertical and horizontal perpendicularly abutting legs 22 and 24, each leg 22 and 24 running the length of the conduit 18. The vertical leg 24 of the L-bracket 20 is oriented substantially parallel to the face of the sidewall 12' for attachment thereto. The horizontal leg 22 extends into the tub volume away from the sidewall 12' and is preferably welded at its point of innermost extension to the top outer edge of the tubular conduit 18.

Figure 3:
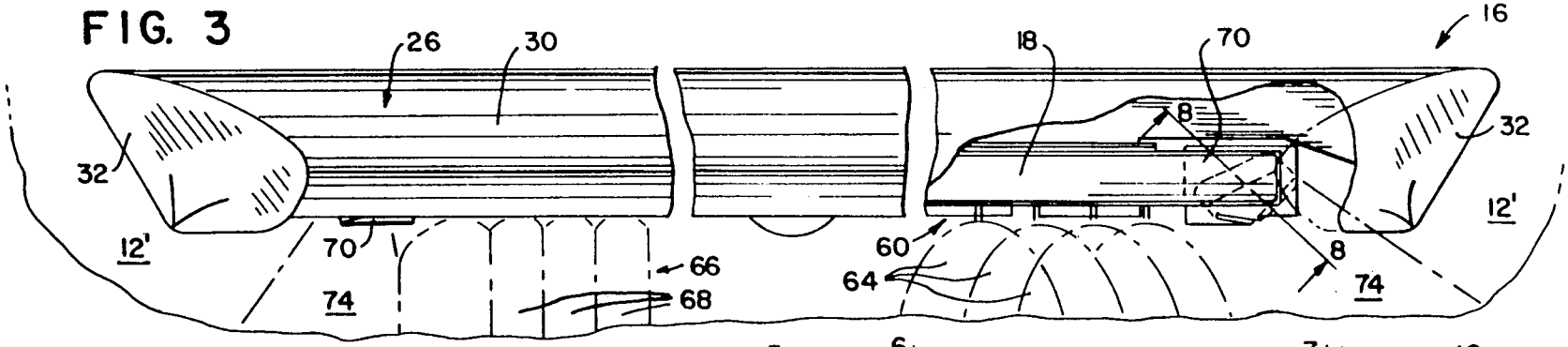
FIG. 3 is a front elevational view (in partial cut-away) of the spout of FIG. 2.

A single length of metal is folded to produce a downwardly opening shroud 26 decoratively covering the conduit 18 and L-bracket 20. The shroud 26 has a substantially planer back wall 28 captured between the vertical leg 24 of the L-bracket 20 and the face of the sidewall 12'. An outer lip 30 of the shroud 26 connects to the planar back wall 28 along its top edge and extends into the tub volume and down over the tubular conduit 18 to hide the tubular conduit 18 from view by a bather (not shown). Shroud end portions 32, shown in FIG. 3, are welded to either end of the shroud 26 at its lateral extremes to close the ends of the shroud 26 between the planer back wall 28 and the lip 30.

Referring again to FIG. 6, bolts 34, fitting through holes in the vertical leg 24 of the L-bracket 20 and through corresponding downwardly opening slots 36 in the planar back wall 28 of the shroud 26, are received by threaded inserts 38 affixed in corresponding holes in the tub sidewall 12'. The bolts 34 hold the vertical leg 24 of the L-bracket 20 and the planar back wall 28, and thus the shroud 26, to the sidewall 12'. The notches 36 in the planer back wall 28 permit the shroud 26 to be installed after the the L-bracket 20 and bolts 34 have been has been installed, by sliding the planar back wall 28 downward along the sidewall 12' and behind the vertical leg 24 of the L-bracket 20, and thereby facilitate installation (and if desired separate removal).

Referring to FIGS. 4 and 5, connector pipe 40 of the same diameter as the tubular conduit 18 joins to the tubular conduit 18 midway along its length to form a T-connection 42 permitting the flow of water from the inlet connector pipe 40 to the tubular conduit 18. A free end of the connector pipe 40 extends toward the sidewall 12', when the tubular conduit 18 is installed against the sidewall 12' on the L-bracket 20, and is received by a tubular sleeve 44 having an inner diameter larger than the outer diameter of the connector pipe 40. An O-ring 46, held coaxially about the free end of the connector pipe 40 by flanking rims 48, is compressed between the outer surface of the connector pipe 40 and the inner surface of the tubular sleeve 44 when the connector pipe is inserted into the tubular sleeve 44 thereby preventing water from escaping from the joint so formed and yet permitting transverse motion of the connector pipe 40 into and out of the tubular sleeve 44 and permitting the adjustment of the tubular conduit 18 toward and away from sidewall 12' as required. The flexible seal created by O-ring 46 and flanking rims 48 also permits a degree of angular adjustment of the axis of connector pipe 40 accommodating variations in the sidewall 12' of tub 10. The seal of O-ring 46 also allows the conduit 18' to be rotated around the axis of the connector pipe 40 to leveling the spout 16.

A notch 50 in the planer back wall 28 of the shroud 26 allows the shroud 26 to fit around the connector pipe 40 and tubular sleeve 44 for removal and installation of shroud 26 without disconnecting the connector pipe 40 from the tubular sleeve 44. The tubular sleeve 44 is attached to the sidewall 12' through a hole in the latter and held in place by means of a flanged nut 52 tightened against the outer side of sidewall 12', the flanged nut 52 engaging external threads on the tubular sleeve 44. The pressure of the flanged nut 52 against the sidewall 12' pulls a rim 58 on the tubular sleeve 44 against a gasket 54 captured between the rim 58 and the inner surface of the sidewall 12' and preventing leakage between the tubular sleeve 44 to the sidewall 12'.

The tubular sleeve 44 is connected to a standard mixer valve (not shown) to receive temperature adjusted water as will be understood by those of ordinarily skill in the art. It will be noted that as soon as this connection to the plumbing service is made, the tubular sleeve 44 may remain affixed to the sidewall 12' by flanged nut 52 because no subsequent motion of the tubular sleeve 44 is required for connecting and disconnecting the spout assembly 16.

Referring to FIGS. 4 and 6, a series of radial ports 60 are regularly spaced along the length of the tubular conduit 18 to direct jets of water 62 against the face of the sidewall 12' when the tubular conduit 18 is connected to the water from the plumbing service through connector pipe 40. The angle $\alpha$ of the jets 62 thus produced is set to direct the jets 62 downward within a range from 15° to 25° from horizontal to strike the sidewall 12' at substantially the same angle. The proper determination of the angle $\alpha$ of the jets 62 and the size of the ports 60 will be discussed below.

Referring to FIG. 3 an individual jet 62 striking the sidewall 12' spreads laterally in a downward widening parabolic stream 64 as dictated by the redirected momentum of the water. The combined effect of the regularly spaced ports 60, however, is such as to generate a substantially continuous sheet of water 66 running the length of the tubular conduit 18 with the edges of the parabolic streams 64 being constrained by the edges of adjacent streams 64 to produce essentially linear downward interfaces 68 between streams. The shroud 26 extends below the tubular conduit 18 and ports 60 sufficiently to hide the parabolic streams 64 prior to their striking the sidewall 12' and joining in a continuous sheet 66.

Referring to FIGS. 3, 7, and 8 at either lateral end of the tubular conduit 18, a nozzle 70 provides a slotted exit 72 for the water in the tubular conduit 18 to form a fan spray of water 74 directed generally downward and laterally outward into the tub volume; the fan spray 74 being a substantially continuous sheet prior to striking the inner surface of the sidewall 12'. The nozzles 70 are fitted over half of the ends of the tubular conduit 18 between the tubular conduit 18 and the sidewall 12'. A cap 76 completes the closure of the ends of the tubular conduit 18. Water communicates between the slotted exit 72 and the tubular conduit 18 through a opening 78 cut in the portion of the tubular conduit 18 received by the nozzle 70 and an channel 80 internal to the nozzle 70. An elastomeric gasket 73 fits between one face of the the nozzle 70 and sidewall 12' to prevent the migration of water upward between the nozzle 70 and the sidewall 12' under certain flow conditions.

Generally, the volume of water necessary to form the fan spray 74, which has a continuous sheet-like form prior to striking the sidewall 12', is substantially greater per area of the sheet so formed than the volume of water forming the sheet 66 of the jets 62. The inner edge of each fan spray 74 merges with the outer edges of the sheet 66 formed by the jets 60 so as to create a visually continuous plane of water whose thickness and volume, as gauged by the edges formed by the fan spray 74 appears substantially greater than is in fact the case. The fan spray 74 and streams 64 created by jets 62 striking sidewall 12' together create a visually continuous sheet flow of water using substantially less volume of water than would be required to form a comparably long free falling sheet flow of water. The interaction of the jets 62 with the sidewall 12' produces a thinner sheet than could be practically produced without attachment of the sheet 66 to the sidewall 12'.

As discussed, the sheet 66 is produced by the spreading of the parabolic streams 64 after the jets 62 strike the sidewall 12'. The spacing and angle of the ports 60 and hence the size and angle of the jets 62 are determined by the desired range of pressures under which the spout assembly must operate. If the spacing of the ports 60 is too wide, or if the port size is too small, or if the angle $\alpha$ is too large, the parabolic streams 64 will not merger to create a single sheet but will produce a comb-like flow. Conversely, if the spacing of the ports 60 is too narrow, or if the port size is too big (assuming adequate pressure), or if angle $\alpha$ is too small, then the parabolic streams 64 merge with such vigor as to detach the water from the sheet 66 from the sidewall 12' along the interfaces 68 creating an undesirable splashing.

The size and number of the port 60 directly affects the volume and pressure of water required by the spout assembly 16. Too many ports 60 producing jets 62 that are too big will require a higher water flow rate than may be delivered by standard plumbing service and hence the pressure in the conduit will fall to below that necessary to support the fan spray 74 at nozzles 70 or the continuous nature of sheet 66. Too large of slot 72 will have a similar effect. If the pressure drop along the length of the tubular conduit 18 is significant, as may be caused by too many ports 60 or ports 60 that are too large, the amount of water flowing in each jet 62 will decrease with distance along the tubular conduit 18 from the connector pipe 40 with adverse consequences for the uniformity of the sheet 66 thus created. The position of the connector pipe 40 midway between the ends of the tubular conduit 18 minimizes the distance the water must flow through the conduit 18 thus decreasing the resistance to flow between the nozzles 70 and the connector pipe 40.

The exact angle $\alpha$ of the jets 62 is preferably 20° for most surfaces. However, "high energy" surfaces such as those produced by waxing may require smaller angles. Conversely "low energy" surface may require somewhat greater angles.

The visual interest of the sheet 66 is enhanced by the series of terraces or ridges 19, shown in FIG. 1, in the tub sidewalls 12 as described above.

The above description has been that of a preferred embodiment of the present invention. For example, the length of the tubular conduit 18 may be increased to the limits imposed by the water supply. Also, tubs need not be rectangular. Thus, it will occur to those who practice the art that many modifications may be made without departing from the spirit and scope of the invention. In order to apprise the public of the various embodiments that may fall within the scope of the invention, the following claims are made.

I claim:

1. A spout for a tub or the like, the tub having a laterally extending vertical wall, the spout comprising:

a conduit having a first and second lateral ends with an inlet therebetween, the conduct being positionable laterally along the upper edge of the vertical wall;

a bracket attachable to the tub for supporting the conduit in a spaced relationship adjacent the vertical wall;

a plurality of ports positioned along the length of the conduit and communicating therewith to receive a portion of flowing water from the inlet and for directing that water in a plurality of water jets at the vertical tub wall to form a continuous sheet of water against that wall, the sheet extending laterally along the vertical wall between a first and second boundary; and a nozzle attached to at least one of said first and second lateral ends of the conduit and communicating therewith to receive another portion of the flowing water from the inlet, and for directing that water against the tub in a fan shaped spray in an at least a partially lateral direction, wherein one edge of the fan shaped spray is adjacent to the continuous sheet of water at one of said first and second boundaries.

2. The spout as recited in claim 1, further comprising a second nozzle attached at the other one of said first and second lateral ends of the conduit and communicating therewith to receive a third portion of the flowing water from the inlet, and for directing that water against the tub in a fan or at least partially lateral direction, wherein one edge of the fan is adjacent to the continuous sheet of water at the other one of said first and second boundaries.

3. The spout as recited in claim 1 further comprising a shroud extending laterally along the conduit and having a laterally extending back wall capturable between the tub vertical wall and the bracket and having a laterally extending bottom opening for permitting unobstructed passage of the plurality of water jets therethrough.

4. The spout as recited in claim 3, wherein a plurality of bolts are provided to hold the bracket against the vertical wall, and the back wall of the shroud has a plurality of downward opening slots to permit the back wall to slide around the bolts and to be clamped between the bracket and the vertical wall by the bolts.

5. The spout as recited in claim 1, wherein the inlet comprises a connector pipe having a first and second end for receiving the flowing water, the first end connected to the conduit and the second end having an elastomeric seal.

6. A sheet flow spout assembly, comprising:

a tub having a vertical side wall which has a plurality of lateral ridges for providing an undulated surface;

a conduit having first and second lateral ends and positioned laterally along the upper edge of the vertical wall;

a bracket attached to the tub holding the conduit in a spaced relationship adjacent the vertical wall;

a plurality of ports positioned along the length of the conduit and communicating therewith to receive a portion of the flowing water from an inlet and for directing that water in a plurality of water jets at the vertical side wall of the tub so as to form a continuous sheet of water on that wall above a portion of the undulated surface, the sheet extending laterally along the vertical wall between a first and second boundary;

a nozzle attached to at least one of said first and second ends of the conduit and communicating therewith to receive another portion of the flowing water from the inlet, and for directing that water against the tub in a fan shaped spray in an at least a partially lateral direction, wherein one edge of the fan shaped spray is adjacent to the continuous sheet of water at one of said first and second boundaries; and the sheet being capable of retaining its sheet form as it passes down over at least one undulation on the tub vertical side wall below the spout.

* * * * *